US006892895B2

(12) United States Patent
Zhu et al.

(10) Patent No.: US 6,892,895 B2
(45) Date of Patent: May 17, 2005

(54) COLLAPSIBLE CONTAINER

(75) Inventors: Xiaotan Zhu, Apopka, FL (US); Datan Zhu, Chang Zhou (CN)

(73) Assignee: AAA Imports, Inc., Apopka, FL (US)

( * ) Notice: Subject to any disclaimer, the term of this patent is extended or adjusted under 35 U.S.C. 154(b) by 77 days.

(21) Appl. No.: 10/090,530

(22) Filed: Mar. 1, 2002

(65) Prior Publication Data

US 2003/0038135 A1 Feb. 27, 2003

Related U.S. Application Data

(60) Provisional application No. 60/314,129, filed on Aug. 22, 2001.

(51) Int. Cl.[7] ..... B65D 6/08

(52) U.S. Cl. ..... 220/489; 220/494

(58) Field of Search ..... 220/494, 489, 220/6, 9.2, 9.4

(56) References Cited

U.S. PATENT DOCUMENTS

| | | | | |
|---|---|---|---|---|
| 820,716 | A | | 5/1906 | Haynes et al. |
| 858,543 | A | | 7/1907 | Sickmiller |
| 1,599,243 | A | | 9/1926 | Parker |
| 1,719,583 | A | | 7/1929 | Blaukowitcsh |
| 1,921,295 | A | | 8/1933 | Hume et al. |
| 2,121,403 | A | | 6/1938 | Lapinskas |
| 2,812,098 | A | | 11/1957 | Escaut |
| 3,013,758 | A | | 12/1961 | Smith |
| 3,229,843 | A | | 1/1966 | Fouinteau |
| 3,314,549 | A | * | 4/1967 | Goldreich et al. ..... 220/6 X |
| 3,762,593 | A | * | 10/1973 | Beretta ..... 220/489 X |
| 4,296,726 | A | | 10/1981 | Ross et al. |
| D263,103 | S | | 2/1982 | Williams |
| 5,267,664 | A | | 12/1993 | Younikian |
| D357,356 | S | | 4/1995 | Muresan |
| D382,710 | S | | 8/1997 | Henderson |
| 5,711,433 | A | | 1/1998 | Smith |
| 5,966,866 | A | | 10/1999 | Ferguson |
| 5,967,360 | A | * | 10/1999 | Cheng-Tien ..... 220/489 |
| 6,027,083 | A | | 2/2000 | Chang |
| 6,050,532 | A | | 4/2000 | Paul |
| 6,088,953 | A | | 7/2000 | Morgan |
| 6,129,208 | A | | 10/2000 | Ferguson |

* cited by examiner

*Primary Examiner*—Joseph Man-Fu Moy
(74) *Attorney, Agent, or Firm*—Norman A. Nixon; Beusse Brownlee Wolter Mora & Maire, P.A.

(57) ABSTRACT

A collapsible container configured to lay substantially flat in a collapsed position and maintain an extended or usable position by utilizing load-bearing means rigidly disposed among and affixed to various support members. The load-bearing means are adapted to receive support members and sustain the container in its usable position when a load is placed therein. The load bearing means resist movement of support members in the direction caused by the load exerted on the container. When the load is removed, the load-bearing means is adapted to permit the support members to be withdrawn there from so that the container may be transitioned to a substantially flat collapsed position.

19 Claims, 3 Drawing Sheets

COLLAPSIBLE CONTAINER

SPECIFIC DATA RELATED TO INVENTION

This application claims the benefit of U.S. Provisional Patent Application, Ser. No. 60/314,129 filed on Aug. 22, 2001.

FIELD OF THE INVENTION

The present invention relates in general to collapsible containers and in particular to a collapsible plant holder configured to lay substantially flat while in its collapsed position and maintain its extended or usable position by utilizing load bearing means rigidly affixed among various support members of the container.

BACKGROUND OF THE INVENTION

A great variety of wire or woven articles such as art baskets, decorative containers and plant holders are known in the art. Such articles have many uses including holding fruit, flowers, potted plants or the like. Some may be constructed of metal or wire for use indoors and outdoors in harsher environments. For example, U.S. Pat. No. 1,719,583 discloses a wire article capable of being twisted, folded, collapsed or extended into a multiplicity of shapes and forms. The wire article is comprised of a plurality of wire members interconnected by hooks disposed on the ends of wires and wire links so that various sections of the article may be articulated about the hooks and wire links to assume different configurations. The hooks of the '583 patent are engageable with wires and secured there over as shown in the figures. Also disclosed is a plurality of concentric loops, which extend outwardly to form the base of the article and serve as supports for the article.

U.S. Pat. No. 5,967,360 discloses an adjustable wire basket having a base section and a continuous, circumferential wall section connected to the base. The basket may rest on a surface or be suspended in a hanging arrangement. The wall section is comprised of a plurality of intertwined, frictionally engaged wire loops, each of which are connected to the base section in a hinged yet friction engagement. As such, the frictional engagement of the intertwined loops and the hinges operate together to permit the wall section to be articulated about the base in any desired angular relationship. In this manner, the wall section defines an inner volume that varies, as the angular relationship is change.

A folding basket is disclosed in U.S. Pat. No. 5,267,664 having pivotable sides allowing the basket to attain and sustain a number of configurations. A platform is secured within the basket near its base to provide a foundation for the basket and support any articles that may be carried by the basket. The pivotable sides are constituted by arcs and may be articulated so the basket may assume different positions. The sides are ostensibly held in a position by bindings that create friction between two articulating arcs. The arcs are supported at their ends by being hooked around a rim defining an outside edge of the basket.

From the foregoing, it can be seen that the prior art is replete with a wide variety of baskets or containers used for holding plants, flowers, fruit, and ornamental or decorative structures, as well as a range of other objects, as desired by the user. Such baskets or containers are frequently constructed from wire and may or may not be collapsible. The '360 invention folds to a flat arrangement and relies on the frictional engagement of intertwined loops to sustain its shape when in use. While this configuration provides ample support for holding certain objects, the frictional engagement may not provide sufficient resistance for heavier objects. Also, the resilient wires of the '360 invention may fatigue over time resulting from frequent movement of the intertwined loops from one position to another, which may lead to a degradation in the basket's ability to retain its shape for holding certain objects.

Many prior art baskets or containers constructed of wire use hooks on the end of wire members that engage other wire members of the construction primarily to provide means for articulating one member around the other. For example, the '583 and '664 patents disclose various configurations of hooks or loops that engage other wire members so that the baskets may assume various shapes by articulating certain members around others. Once engaged, the hooks or loops are secured over another member to provide a hinge means that does not easily become disengaged. Some of the hinge means also sever as load-bearing means and as such are limited in the amount of weight they can support due to their propensity to rotate as a hinge when a sufficient load bears on them that exceeds the coefficient of friction established by the hinge means. While this feature is advantageous in that the baskets may assume various configurations, the need to have numerous hinge means and articulating members limits each basket's load bearing capacity in certain configurations.

It would be advantageous to provide a container that is quickly collapsible to a substantially flat position, aesthetically pleasing, of lightweight construction and that has a load bearing capacity suitable for holding relatively heavy decorative objects such as potted plants or the like.

SUMMARY OF THE INVENTION

In one aspect of the present invention a container is provided that may be collapsed to a substantially planar position and extended to a usable position suitable for holding a variety of objects such as potted plants or other decorative objects, for example. In the extended or usable position, load-bearing means may be provided for receiving and engaging a member of the container when the container is under a load. The load-bearing means helps to sustain the load and resist movement of the member it is supporting in a direction caused by the load. When the load is removed, the member may be disengaged from the load-bearing means so that the container may be collapsed into its substantially planar or flat configuration. The container may be constructed of appropriately gauged wire or other suitable material.

One advantage of the present invention is that the container may be easily converted from an extended or usable position to a substantially planar position. In one aspect of the present invention, the conversion is made easy by the design and location of load-bearing means, which may comprise a hook having an open end affixed to certain support members of the container. The hook may be affixed to the members by conventional means such as spot welding or soldering, for example. Alternatively, the hook may be an integral part of the member if the container design lends itself to that type of fabrication. Further, each embodiment of the present invention may have at least two support members that are rotatably connected to each other or a base member for movement of the members from the usable to flat configuration. The rotatable connection may be any style known in the art, such as a hinge, or the intersection of two bent wire shapes, for example.

Each load-bearing means may have an open end that receives and retains a portion of a support member of the container so that the container will retain its shape even under its own weight alone. The open end may be a slot, U-shaped opening or other appropriate configuration. When a load is placed within the container the support member may be urged toward the load-bearing means, or visa versa depending on the configuration, thereby creating a force against the load-bearing means, which resists the force and consequently movement of the support member under the load in a direction caused by the force. When the load is removed, the support member may be separated from the load-bearing means so that container may be conveniently collapsed into its flat position.

Numerous embodiments of the present invention will be readily apparent to those skilled in the art. For example, hanging plants are a very popular decorative feature in homes and offices. One exemplary embodiment of the present invention may provide a container constructed of wire, which may be specifically adapted for receiving a plant that will be hung from the ceiling of a house or apartment, for example. This configuration may include a plurality of loop segments disposed around the circumference of a circular rim such that each loop may be articulated about the rim to transform the container from its substantially flat position to its usable position, and visa versa. The wire loops may be semi-elliptical in shape, for example. Other shapes may be equally adapted for use within the scope of the present invention. In one exemplary embodiment, an even number of loops are disposed around the rim so that each terminal or distal end of a loop connecting the loop to the rim, overlaps the end of an adjacent loop. Overlapping the ends of adjacent loops urges the loops to move in unison when being transitioned between planar and extended positions, which helps to facilitate the transition and maintain the loops in order. A load-bearing means may be affixed to every other loop near that loop's apex and is adapted to receive a portion of an adjacent loop when the container is in its usable position. As would be apparent to those skilled in the art, alternate embodiments may include more than one load-bearing means disposed on every other loop or one load-bearing means may be disposed on each loop. The number and placement of load-bearing means may vary depending on the size of the container and the load it is intended to support.

In the exemplary embodiment described above, as the loops move from their flat position toward the usable position, the leg portions of each pair of adjacent loops define a point of intersection with each other that traverses along the length of each leg and approaches the point where the apex of adjacent loops would intersect one another. Each load-bearing means may be affixed at a point of intersection defined by two adjacent loops and may have an open end that faces in a direction that is substantially opposite the direction of the force applied by that adjacent loop when the container is loaded. When the container is in its usable position, the load-bearing means captures a portion of an adjacent loop and causes the loop to resist the forces exerted when the container is loaded. Also, stoppers are disposed around the circumference of the container's rim to prevent the terminal ends of the loops from moving too far from their intended positions on the rim.

Another exemplary embodiment of the present invention may comprise a plurality of support members that when extended into their usable position may form a rectangular structure resembling a flower box of the type that may frequently be found on the window sill of a house, for example. In the extended position, load-bearing means may engage portions of the structures' sidewalls and be urged against the sidewalls under the structures' own weight and configuration. When a load is placed within the structure, the load-bearing means engage the sidewalls to resist the force being exerted by the load.

Another exemplary embodiment of the present invention may be shaped to resemble a half wall basket frequently found in and outside of homes, for example. This embodiment may comprise an arcuate or curvilinear rim that rotatably engages a back plate. A plurality of arcuate or curvilinear support rods may rotatably engage and depend from the rim with their distal ends releasably engaging a lower portion of the back plate. An arcuate or curvilinear center rod also may rotatably engage the back plate and seat against the depending support rods to define the area within which an object may be supported. Load-bearing means may be affixed to one or more of the depending support rods to resist the force exerted by the load.

The various exemplary embodiments of the present invention as well as others envisioned by the scope and spirit of the appended claims provide advantages over prior art baskets. For example, embodiments of the present invention have aesthetically pleasing configurations that are quickly and easily convertible from a collapsed position, which is substantially planar, to an extended or usable position that retains its shape and is strong enough to hold relatively heavy objects such as potted plants. The planar position allows for ease of storage and moving from place to place within one's home, for example, and provides a significant costs savings for packaging and shipping over prior art designs that do not collapse or those that don't collapse to a substantially planar structure.

Another advantage of the present invention is that it may comprise a plurality of articulating support members that provide a rigid structure when in its usable position and allow for the structure to be quickly and easily collapsed into a substantially planar structure.

DESCRIPTION OF THE INVENTION

Figure 1:
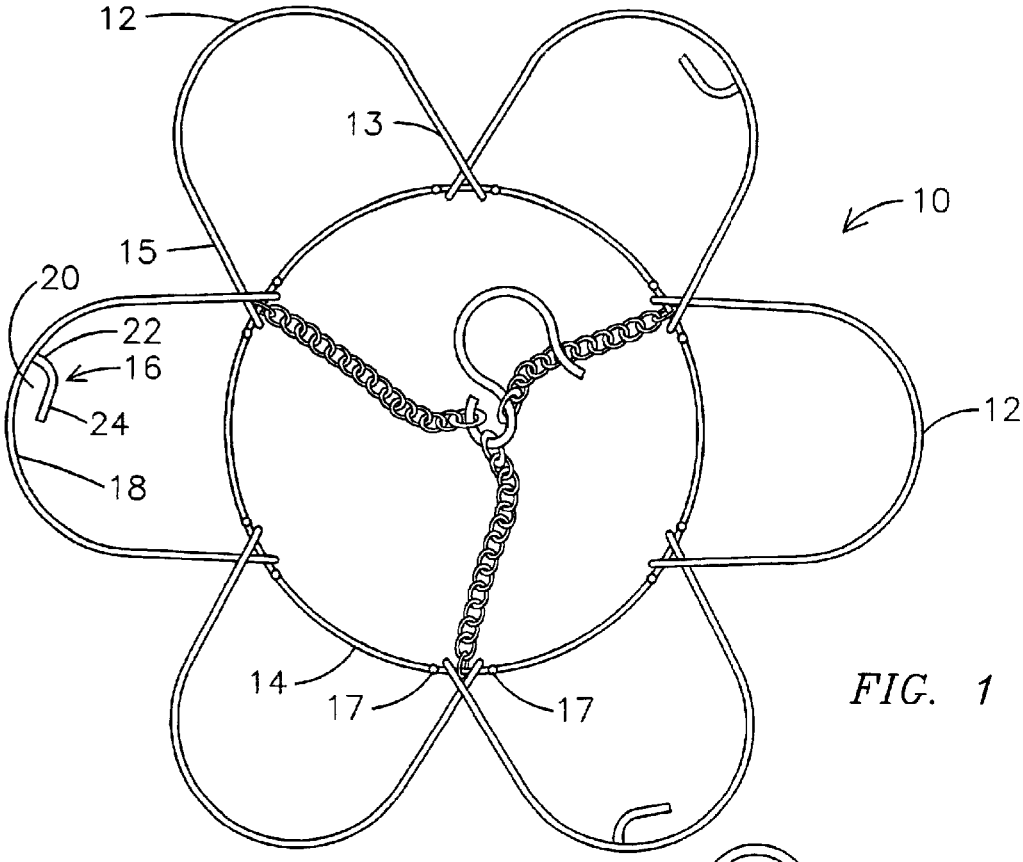
FIG. 1 illustrates a plan view of one embodiment of the present invention in its collapsed configuration.

FIG. 1 illustrates one exemplary embodiment of a container of the present invention, which is generally referred to as 10. The container 10 may include a plurality of support members such as loop segments 12 circumferentially disposed around a base member such as a circular rim 14. Each loop segment 12 may include a first distal end 13 and a second distal end 15, as more clearly shown in FIG. 2. Each distal end 13 and 15 may be rotatably connected with a rim 14 by any conventional means such as an eyelet formed in each end as an integral part of a loop segment 12 or other appropriate means. The loop segments 12 may be disposed around rim 14 so that the first distal end 13 of one loop segment 12 overlaps the second distal end 15 of the adjacent loop segment 12 immediately next to it. Alternatively, the distal ends 13 and 15 of adjacent loop segments 12 may abut one another rather than overlap. A plurality of stoppers 17 may be disposed on the circumference of rim 14 to prevent movement of the distal ends of the loop segments 12 outside a predetermined distance on the rim 14. Stoppers 17 may be round metal knobs affixed to the rim 14 by any conventional means such as spot welding or soldering, for example.

Figure 6:
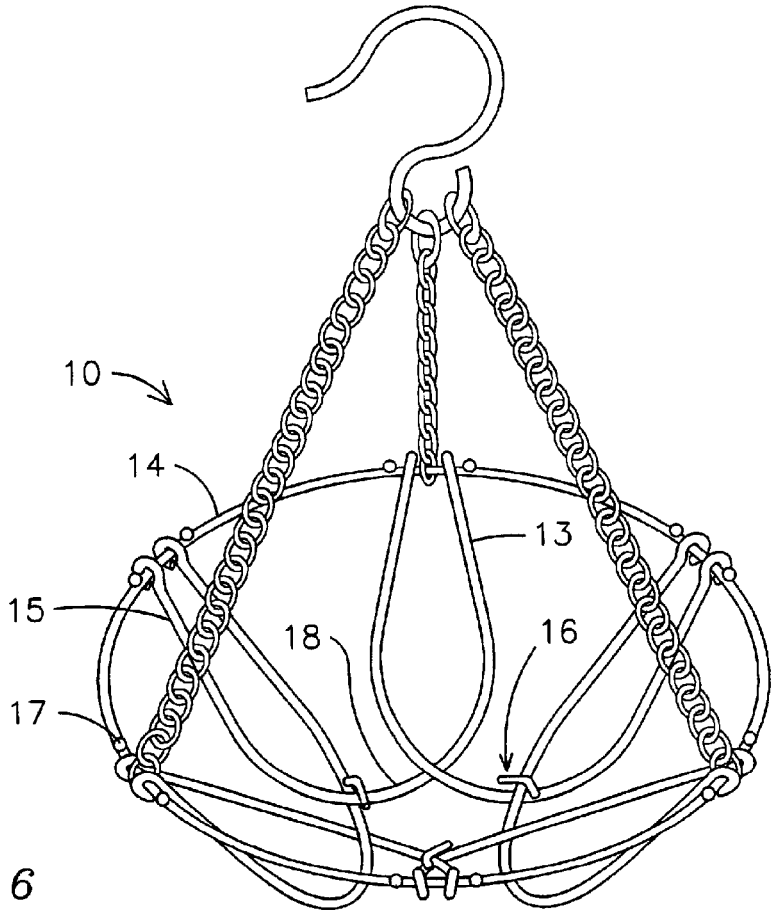
FIG. 6 illustrates a perspective view of the embodiment of FIGS. 1 and 2 in its extended position.

FIG. 1 also illustrates load-bearing means 16, which may be rigidly affixed by any conventional means, such as spot welding or soldering, to one or more loop segments 12. In one exemplary embodiment, load-bearing means 16 are affixed to alternating loop segments 12 and are adapted to receive a portion of an adjacent loop segment 12 when all loop segments 12 are moved to an extended or usable configuration. In its extended configuration the interior of container 10 defines a volume within which an object may be placed, as best shown in FIG. 6. Load-bearing means 16 may be affixed near a curvilinear portion 18 of loop segment 12 or they may be affixed to other portions of loop segment 12 to accommodate for adjustments to the size or shape of container 10. Additionally, when affixed to loop segment 12, load-bearing means 16 may define a plane that is oblique to or offset from a plane defined by loop segment 12. The load-bearing means 16 may define an opening 20 for receiving a portion of an adjacent loop segment 12 when the container 10 is in its usable configuration, as best shown in FIG. 6.

Figure 2:
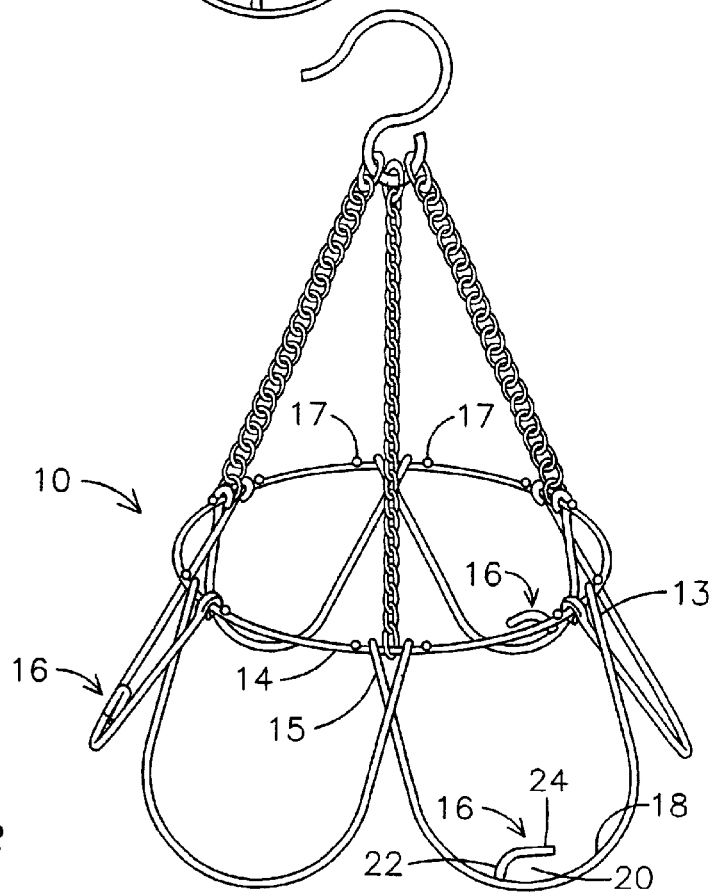
FIG. 2 illustrates a perspective view of the embodiment of FIG. 1 in a partially extended configuration.

As can be appreciated from FIGS. 1, 2 and 6, container 10 may be transformed from a substantially planar configuration to an extended configuration for holding an object. In the extended position, the support members, such as loop segments 12, of the container 10 define a substantially hemispherical volume within which a potted plant or other objects may be placed.

Load-bearing means 16 may be configured substantially as a hook as shown in FIG. 1, which may include a first leg 22 extending substantially perpendicular from loop segment 12 and a second leg 24 extending at a substantially right angle from first leg 22. This configuration may define an opening 20 between second leg 24 and the loop segment 12. Load-bearing means 16 may be formed by alternate configurations such as an arcuate or hook shaped wire, or a straight wire segment, for example, extending from loop segment 12. In one exemplary embodiment, first leg 22 and second leg 24 receive a portion of an adjacent loop segment 12 when the container 10 is in its extended or usable position, as shown in FIG. 6. In this manner, a portion of the adjacent loop segment 12 may impinge upon the first leg 22 and/or the second leg 24 either under its own weight or when an additional force is exerted on the loop segments 12 when an object is placed within container 10. A portion of any adjacent loop segment may also impinge on a portion of the adjacent loop segment to which the load-bearing means is affixed when the container 10 is in its extended position.

Figure 3:
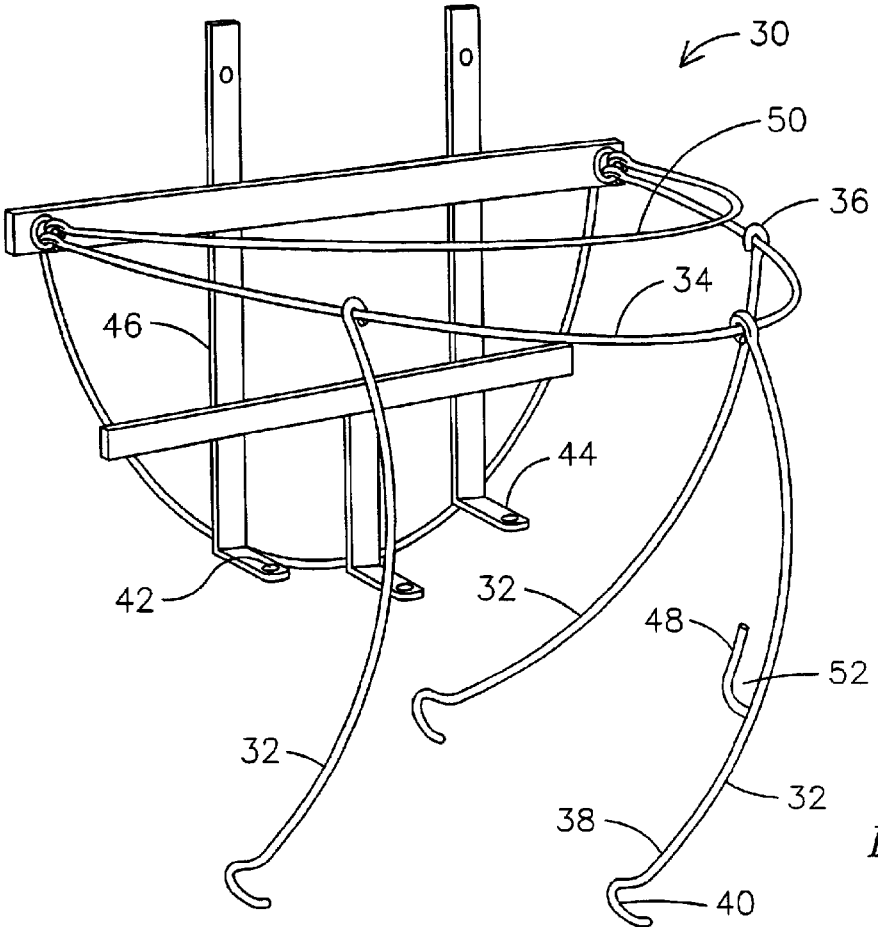
FIG. 3 illustrates a perspective view of another exemplary embodiment of the present invention a partially collapsed configuration.
Figure 4:
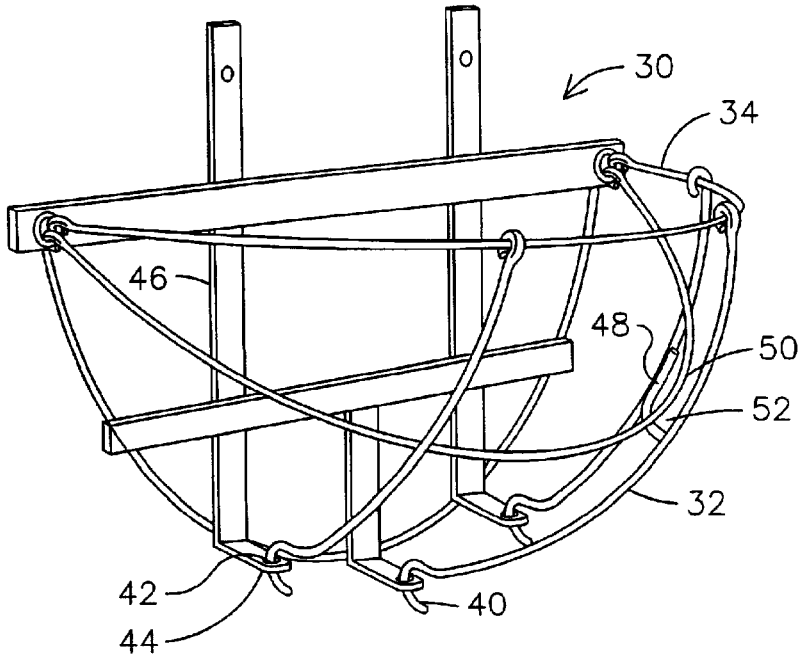
FIG. 4 illustrates a perspective view of the embodiment of FIG. 3 in its extended position.

FIGS. 3 and 4 illustrate another exemplary embodiment of a container of the present invention, which is generally referred to as 30. Container 30 may include a plurality of support members such as the depending support member rods 32. Rods 32 may rotatably engage a first brace 34 by any conventional means such as an eyelet formed in a proximal end 36 of rod 32. Rods 32 may be curvilinear to define a volume for accepting an object of similar shape or they may be substantially liner or have right angles to form a rectangular volume, for example. Load-bearing means may be formed in the distal end 38 of rod 32 such as a hook 40, which may be formed as an integral part of rod 32, or affixed thereto by conventional means. Alternately, load-bearing means may comprise a clamp, latching mechanism or other suitable configurations. Hook 40 may be releasably inserted into a corresponding aperture 42 formed within a corresponding tab 44. Tab 44 may extend substantially horizontally from a base 46. Hook 40 bears the load exerted by rod 32 under its own weight and additional load exerted on the container 30 when an object is placed therein. In one exemplary embodiment, three rods 32 rotatably depend from a first brace 34 with hooks 40 being releasably inserted into corresponding apertures 42 formed in corresponding tabs 44. Load-bearing means such as a catch 48 may be provided on one or more of the rods 32 for receiving a support member such as a second brace 50. The first brace 34 and second brace 50 may rotatably engage a base member such as a substantially planar back plate 46. Back plate 46 may be formed of intersecting metal strips, for example, or it may be other configurations such as a solid piece of lightweight metal. First brace 34 and second brace 50 may rotatably engage back plate 46 by any conventional means, such as a hook and eyelet, so that they may be articulated between a collapsed position and an extended or usable position. In the extended position shown in FIG. 4, the catch 48 may define an open end 52 for receiving the second brace 50. The catch 48 bears the load exerted by the second brace 50 under its own weight and an additional load exerted by the container 30 when an object is placed therein.

Figure 5:
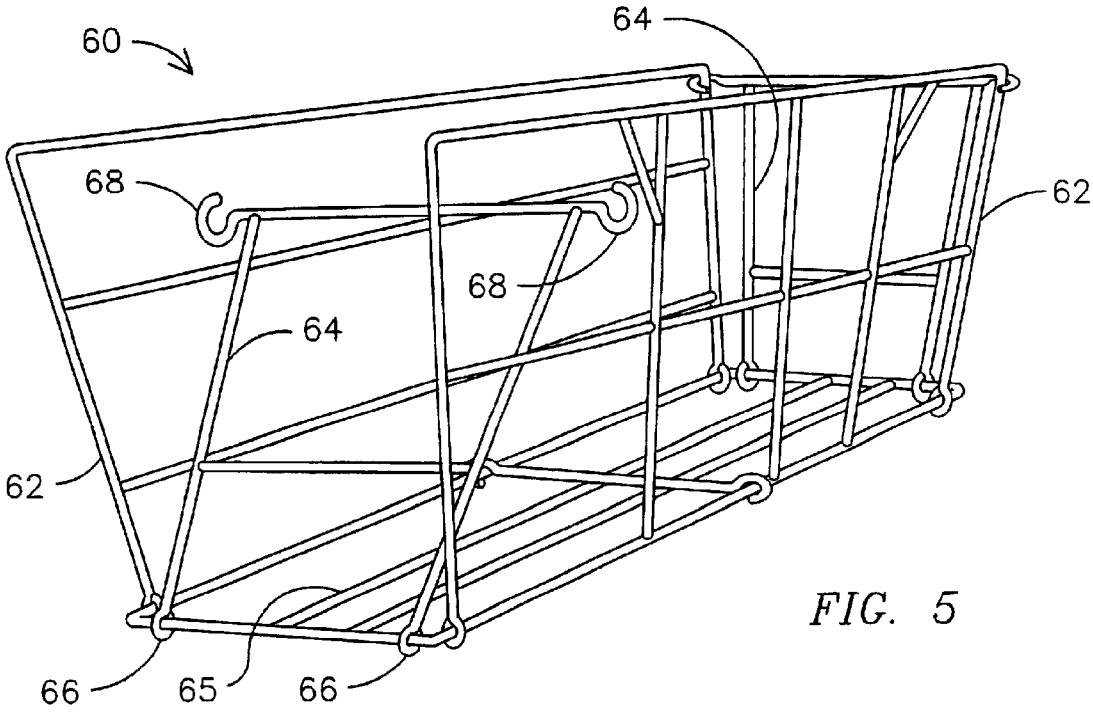
FIG. 5 illustrates a perspective view of another exemplary embodiment of the present invention a partially collapsed configuration.

FIG. 5 illustrates another exemplary embodiment of a container of the present invention, which is generally referred to as 60. Container 60 may include supporting members such as side frames 62 and end frames 64. Side frames 62 and end frames 64 may rotatably engage a base member such as the substantially planar frame 65 by any conventional means. For example, hooks 66 may be formed in the side and end frames and be secured over a portion of the planar frame 65 so that the frames 62 and 64 may be articulated between a collapsed position and an extended or usable position. Container 60 is substantially planar when in the collapsed position. Load-bearing means such as hooks 68 may be disposed near the top portion of end frames 64 so they releasably engage a portion of the side frames 62 when container 60 is in its extended position. Hooks 66 bear the load exerted by end frames 64 under their own weight and additional load when container 60 contains an object.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim:

1. A collapsible container comprising:

a base member;

at least one support member for supporting an object placed in the container, the at least one support member rotatably connected with the base member for articulating the container between an essentially two-dimensional planar configuration and an extended configuration wherein a plane defined by the at least one support member is oblique with respect to a plane defined by the base member; and means for bearing a load exerted by the at least one support member when an object is placed in the container while in the extended configuration, the means for bearing a load comprising at least one hook having an open end affixed to at least one of the support members and adapted to resist movement of the at least one support member in a direction caused by the load wherein the at least one hook receives a respective one of the at least one support member when the container is in the extended configuration.

2. The collapsible container of claim 1, the at least one hook comprising a plurality of hooks wherein one of the hooks is affixed to alternating support members and adapted to receive a portion of an adjacent support member when the container is in the extended configuration.

3. A collapsible container comprising:

a base member;

at least one support member for supporting an object placed in the container, the at least one support member rotatably connected with the base member for articulating the container between an essentially flat configuration and an extended configuration;

means for bearing a load exerted by the at least one support member when an object is placed in the container while in the extended configuration, the means for bearing a load comprising at least one hook having an open end affixed to at least one of the support members and adapted to resist movement of the at least one support member in a direction caused by the load wherein the at least one hook receives a respective one of the at least one support member when the container is in the extended configuration; and a plurality of support members, the base member comprising a circular rim, the plurality of support members being circumferentially disposed on the rim, each of the support members having a first distal end and a second distal end connecting the support member to the rim, the support members being disposed so that one of the distal ends of a support member overlaps with one of the distal ends of an adjacent support member.

4. The collapsible container of claim 3 further comprising:

a plurality of stoppers circumferentially disposed on the rim, the stoppers adapted to prevent movement of the plurality of support members outside a predetermined area; and means for hanging the container.

5. A collapsible container comprising:

a base member;

at least one support member for supporting an object placed in the container, the at least one support member rotatably connected with the base member for articulating the container between an essentially flat configuration and an extended configuration;

means for bearing a load exerted by the at least one support member when an object is placed in the container while in the extended configuration, the means for bearing a load comprising at least one hook having an open end affixed to at least one of the support members and adapted to resist movement of the at least one support member in a direction caused by the load wherein the at least one hook receives a respective one of the at least one support member when the container is in the extended configuration;

the base member comprising a substantially planar back plate adapted to be mounted to a flat surface;

the at least one support member comprising a first arcuate brace and a second arcuate brace rotatably connected to the back plate, at least one depending support member each having a proximal end and a distal end, the proximal end rotatably connecting the depending support member to the first arcuate brace and the distal end being adapted to releasably engage the back plate; and the means for bearing a load comprising at least one hook having an open end affixed to at least one of the depending support members, the hook adapted to receive a portion of the second arcuate brace when the container is in the extended configuration.

6. The collapsible container of claim 1:

the base member comprising a substantially planar frame;

the at least one support member comprising a first side frame, a second side frame, a first end frame and a second end frame; and the means for bearing a load comprising at least one hook affixed to at least one of the support members, the hook adapted to receive a portion of one of the support members when the container is in the extended configuration.

7. The collapsible container of claim 5 further comprising three depending support members, the means for bearing a load further comprising a hook affixed to a respective distal end of at least one of the three depending support members and adapted to releasably engage a corresponding aperture in the back plate, wherein the depending support members are curvilinear.

8. A collapsible container comprising:

a base member, the base member comprising a circular rim and the plurality of support members are circumferentially disposed on the rim;

a plurality of support members rotatably connected with the base member for articulating the container between a substantially flat configuration and an extended configuration for holding an object, the object exerting a load when placed in the container; and at least one hook having an open end affixed to at least one of the plurality of support members wherein at least one of the plurality of support members engages the at least one hook when the load is exerted on the plurality of support members, the at least one hook being adapted to resist movement of the engaging support member in a direction caused by the load.

9. The collapsible container of claim 8 wherein each of the plurality of support members comprising a semi-elliptical loop segment.

10. The collapsible container of claim 8, each of the plurality of loop segments comprising a first distal end and a second distal end rotatably connecting the loop segment to the rim; and the first and second distal ends of a loop segment being disposed in an overlapped relationship with the first and second distal ends of adjacent loop segments.

11. The collapsible container of claim 9 further comprising:

an even number of support members wherein the at least one hook is affixed to alternate support members so that each hook is engaged by an adjacent support member when the container is in its extended configuration.

12. The collapsible container of claim 11 further comprising:

a plurality of stoppers circumferentially disposed on the rim, the stoppers adapted to prevent movement of the plurality of support members outside a predetermined area; and means for hanging the container.

13. A collapsible container comprising:

a base member, the base member comprising a substantially planar back plate adapted to be mounted to a flat surface;

a plurality of support members rotatably connected with the base member for articulating the container between a substantially flat configuration and an extended configuration for holding an object, the object exerting a load when placed in the container;

at least one hook having an open end affixed to at least one of the plurality of support members wherein at least one of the plurality of support members engages the at least one hook when the load is exerted on the plurality of support members, the at least one hook being adapted to resist movement of the engaging support member in a direction caused by the load; and the plurality of support members comprising a first arcuate support member rotatably connected with the back plate for articulating the first arcuate support member between a position that is in substantially the same plane defined by the back plate and a position that is substantially perpendicular to the back plate.

14. The collapsible container of claim 13, the plurality of support members further comprising:

a second support member rotatably connected with the back plate for articulating the second support member between a position that is in substantially the same plane defined by the back plate and a position that is oblique to the back plate; and at least one depending support member, the at least one depending support member comprising a proximal end rotatably engaging the first support member and a distal end adapted to releasably engage the back plate.

15. The collapsible container of claim 14 wherein the at least one hook is affixed to the at least one depending support member and adapted to receive a portion of the second support member.

16. A collapsible container comprising:

a base member;

at least one support member for supporting an object placed in the container, the at least one support member comprising a plurality of semi-elliptical loop segments rotatably connected with the base member for articulating the container between an essentially flat configuration and an extended configuration; and means for bearing a load exerted by the at least one support member when an object is placed in the container while in the extended configuration, the means for bearing a load adapted to resist movement of the at least one support member in a direction caused by the load and comprising at least one hook having an open end affixed to at least one of the support members.

17. The collapsible container of claim 16, the at least one hook comprising a plurality of hooks wherein one of the hooks is affixed to alternating support members and adapted to receive a portion of an adjacent support member when the container is in the extended configuration.

18. A collapsible container comprising:

a base member;

a plurality of support members rotatably connected with the base member for articulating the container between a substantially flat configuration and an extended configuration for holding an object, the object exerting a load when placed in the container;

at least one hook having an open end affixed to at least one of the plurality of support members wherein at least one of the plurality of support members engages the at least one hook when the load is exerted on the plurality of support members, the at least one hook being adapted to resist movement of the engaging support member in a direction caused by the load;

the base member comprising a circular rim and the plurality of support members are circumferentially disposed on the rim;

each of the plurality of support members comprising a semi-elliptical loop segment; and an even number of support members wherein the at least one hook is affixed to alternate support members so that each hook is engaged by an adjacent support member when the container is in its extended configuration.

19. The collapsible container of claim 18 further comprising:

a plurality of stoppers circumferentially disposed on the rim, the stoppers adapted to prevent movement of the plurality of support members outside a predetermined area; and means for hanging the container.

* * * * *